US011033925B2

(12) United States Patent
Juvert Vila et al.

(10) Patent No.: US 11,033,925 B2
(45) Date of Patent: Jun. 15, 2021

(54) DEVICE FOR THE SURFACE COATING OF PIECES

(71) Applicant: GIRBAU, S.A., Barcelona (ES)

(72) Inventors: Adam Juvert Vila, Barcelona (ES); Xavier Perpinya Zarza, Barcelona (ES)

( * ) Notice: Subject to any disclaimer, the term of this patent is extended or adjusted under 35 U.S.C. 154(b) by 131 days.

(21) Appl. No.: 16/597,523

(22) Filed: Oct. 9, 2019

(65) Prior Publication Data

US 2020/0114389 A1 Apr. 16, 2020

(30) Foreign Application Priority Data

Oct. 10, 2018 (ES) ..... ES201831542

(51) Int. Cl.

| | |
|---|---|
| ***B05C 11/10*** | (2006.01) |
| ***B05C 9/02*** | (2006.01) |
| ***B05C 3/09*** | (2006.01) |
| ***B05C 3/00*** | (2006.01) |

(52) U.S. Cl.

CPC ..... *B05C 11/1039* (2013.01); *B05C 3/005* (2013.01); *B05C 3/09* (2013.01); *B05C 9/02* (2013.01); *B05C 11/101* (2013.01); *B05C 11/1002* (2013.01)

(58) Field of Classification Search

None

See application file for complete search history.

(56) References Cited

U.S. PATENT DOCUMENTS

| | | | | |
|---|---|---|---|---|
| 5,766,359 | A * | 6/1998 | Sichmann | B05C 11/08 118/319 |
| 5,863,328 | A * | 1/1999 | Sichmann | B05B 15/70 118/52 |
| 7,341,634 | B2 * | 3/2008 | Yokoyama | C23C 18/1619 118/429 |
| 8,464,654 | B2 * | 6/2013 | Barjon | C23C 2/003 118/429 |
| 9,789,505 | B2 * | 10/2017 | Kimpel, Jr. | B05B 15/55 |
| 9,811,096 | B2 * | 11/2017 | Hayashi | H01L 21/67017 |
| 9,972,513 | B2 * | 5/2018 | Saito | H01L 21/67253 |
| 2001/0029887 | A1 * | 10/2001 | Falck | B05C 11/1039 118/694 |
| 2004/0071883 | A1 * | 4/2004 | Ogawa | B05C 1/0813 427/378 |
| 2015/0017332 | A1 * | 1/2015 | Zolli | B05C 11/1039 427/345 |

* cited by examiner

*Primary Examiner* — Jethro M. Pence

(74) *Attorney, Agent, or Firm* — Eugenio J. Torres-Oyola; Victor M. Rodriguez-Reyes; Rafael Rodriguez-Muriel

(57) ABSTRACT

A device for performing a surface coating of pieces is disclosed. The device comprises a housing including one leak-tight cavity containing a drum, heating means, at least one water inlet conduit and one dyeing agent inlet conduit, and a recovery tank and a fluid recirculation circuit from said recovery tank to said leak-tight cavity and drum. The leak-tight cavity includes a first level sensor connected to a control device, such that the entry of water to the leak-tight cavity is interrupted when a specific level is reached inside the cavity, and the recovery tank includes at least a second level sensor connected to the control device, such that the entry of water and dyeing agent to the leak-tight cavity is interrupted if a specific level is exceeded inside the recovery tank.

14 Claims, 1 Drawing Sheet

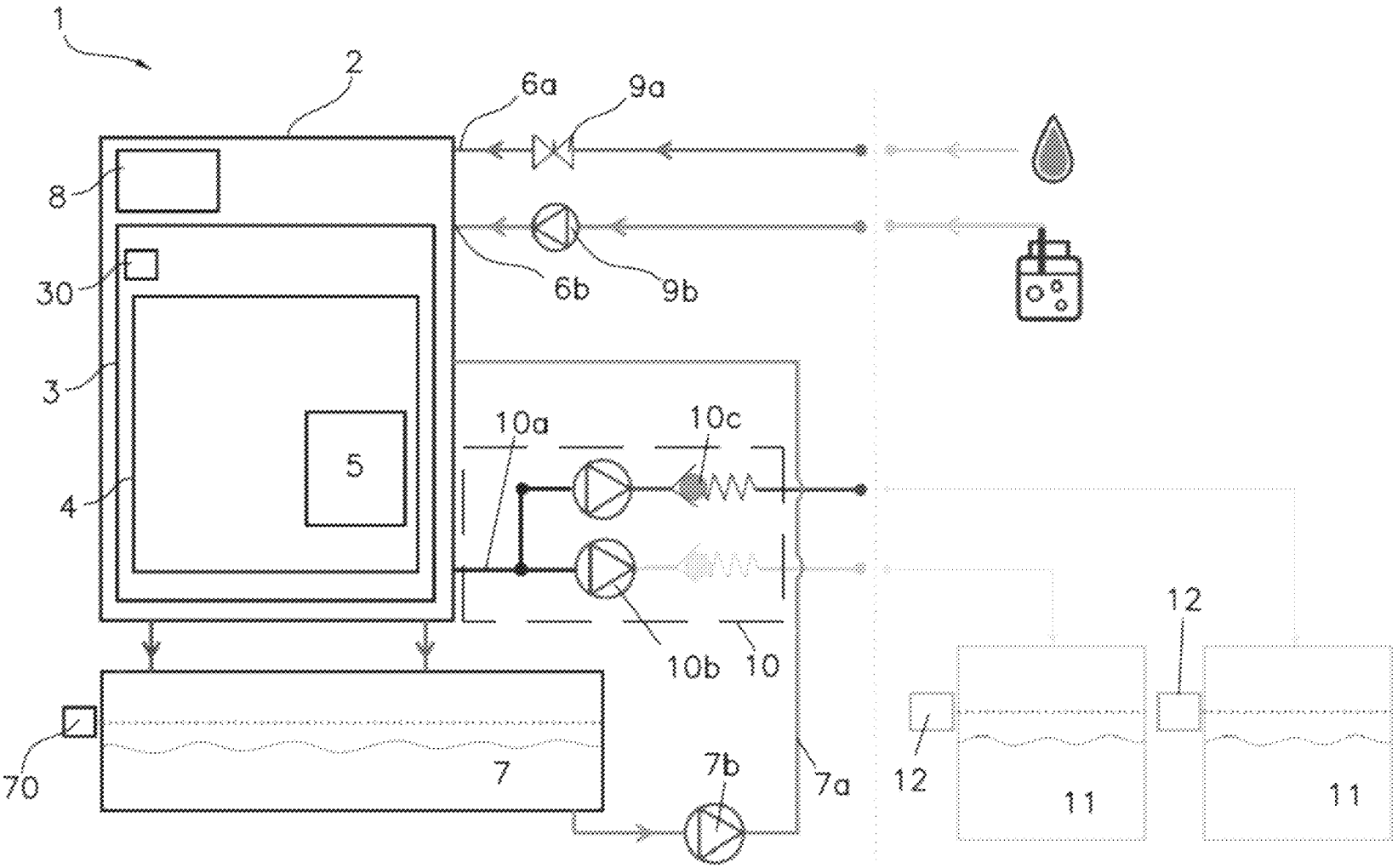
1
2
3
4
5
6a
6b
7
7a
7b
8
9a
9b
10
10a
10b
10c
11
11
12
12
30
70

DEVICE FOR THE SURFACE COATING OF PIECES

FIELD OF THE ART

The present invention describes a device for performing a surface coating of parts or pieces, mainly pieces obtained based on additive manufacturing techniques (according to a method also commonly known as additive manufacturing), such as for example, stereolithography (SL or SLA), selective laser sintering (SLS), fused deposition modeling (IDM), or other 3D printing and/or rapid prototyping techniques.

The mentioned surface coating to be performed on said pieces is the application of a dyeing agent to the outer surface of the pieces by means of dipping said pieces in a water-based dye solution.

STATE OF THE ART

There is a great variety of processes and devices which allow coating the surfaces of pieces with a substrate so that these pieces obtain an optimum and homogenous (uniform) visual appearance for decorative or esthetic purposes and/or for modifying or improving the surface properties of the coated pieces. Some of these processes include, among others, coating based on:

- chemical vapor deposition,
- physical vapor deposition,
- application of thin film substrates applied to the outer surface of the pieces,
- use of aerosols or sprays, or
- dipping in a dye solution, with the present invention referring to the latter. Dip coating consists of manually or automatically immersing the pieces to be coated in an appropriate leak-tight bath, cavity, or receptacle containing a dye solution at a predetermined temperature and for a predetermined time.

U.S. Pat. No. 4,726,318 describes a device for coating parts with a dye solution, formed by a cylindrical dyeing tank having a stationary hollow shaft extending horizontally and axially therethrough for ejecting a dye solution, with a cylindrical tank rotatably mounted on said shaft in which the pieces are inserted, and an auxiliary tank which is coupled directly with the bottom of the dyeing tank and integrates heating means, inside which the mixing of dye solution is performed, and it has a recirculation system connected to the hollow shaft.

The purpose of the present invention is to propose a new design of a device for improving the process for the surface treatment of pieces, simplifying said process which is carried out, combining and/or performing steps in a simultaneous manner, reducing the size of the network of conduits integrated in the device itself, in addition to including safety elements to assure that the device works under optimum working conditions, while at the same time preventing possible leaks or spillage of the dye solution and losses therein during a work cycle.

BRIEF DESCRIPTION OF THE INVENTION

The present invention describes a device for performing a surface coating of pieces, wherein said device is formed by a housing including at least: one leak-tight cavity containing a drum where pieces to be coated are introduced, heating means, one or more water supply conduits and at least one dyeing agent inlet conduit for entry to said leak-tight cavity and drum, the mentioned water inlet conduit and dyeing agent inlet conduit being controlled by a control unit by means of a control device, and there being provided a recovery tank in communication with said leak-tight cavity and a fluid recirculation circuit from said recovery tank to said leak-tight cavity and said drum.

In a particular embodiment, the drum arranged inside the leak-tight cavity has a cylindrical geometry, is installed in a horizontal configuration, and has a plurality of perforated holes which allow the flow of a dye solution between the leak-tight cavity and the inside of the drum where the pieces arc located, said dye solution being the result of the prior mixing of water and a dyeing agent.

Once the pieces and the dye solution are inside the drum and the device is performing a work cycle, the drum can be in a standby or stationary position, or preferably performs a dynamic movement about a drive shaft operated by an actuator, wherein said dynamic movement is preferably selected from: an oscillating or back-and-forth movement or a rotational movement. It must be pointed out that the mentioned drive shaft actuating the drum is preferably coaxial to an imaginary central axis defined by the geometry of the drum.

The pieces are introduced into the drum through a gate, and they can optionally be introduced in pouches or bags to prevent possible defects resulting from the impact of the parts with the inner surface of the drum, causing scratches, cracks, or indentations, among other possible defects in the parts.

The present invention is characterized in that the leak-tight cavity includes a first level sensor which is directly or indirectly connected to the control device of the water supply conduit, such that the entry of water to the leak-tight cavity, and therefore to the drum in which the parts to be coated will be introduced, is interrupted if a predetermined water level is reached inside the leak-tight cavity for performing an optimum mixing of water and said dyeing agent inside the drum. The level sensor of the leak-tight cavity is preferably an analog transducer, and it can also be located inside the drum, performing the same function, instead of in the leak-tight cavity.

Further more, the present invention additionally has at least a second level sensor which is integrated in the recovery tank installed below the housing of the device and directly or indirectly connected to the control device of the at least one water inlet conduit and the at least one dyeing agent inlet conduit, such that the entry of water and dyeing agent to the leak-tight cavity and to the drum is interrupted if a specific level, compatible with its capacity, is exceeded inside the recovery tank, so as to prevent possible leaks or spillage of the dye solution.

The described device can furthermore include a dye solution discharge system which is located in the leak-tight cavity comprising at least one outlet from said cavity, each outlet being controlled by a discharge pump and a non-return valve, wherein each outlet of the discharge system is connected to one or more water treatment tanks. The discharge system is automatically activated by said control unit, after the selection of a predetermined program stored in its memory, once the dye solution has performed or exceeded a number of predetermined work cycles in which it has been recirculated, or once it has exceeded a predetermined time period of service life.

Each discharge pump associated with an outlet conduit is controlled by a level sensor integrated in at least one of the one or more water treatment tanks, such that it is activated or deactivated according to the signal emitted by the level sensor associated with said discharge pump, indicating if the level inside the tank is lower than or equal to or greater than a predetermined maximum level.

Moreover, the heating means used in the device are preferably heating coils with two thermal contacts, controlled by a programmable safety relay, and in a preferred embodiment they are included inside the drum, although they may also be introduced in the leak-tight cavity, obtaining a similar heating effect. It must be pointed out that the use of other equivalent heating means, such as for example, radiator-type heat exchangers, would be obvious for one skilled in the art and must be considered as an equivalent as the same purpose is achieved.

In a preferred embodiment, the control device of the water inlet conduit is a solenoid gate valve and the mentioned control device of the dyeing agent inlet conduit is a regulating pump.

The operating principle of the device is as follows:

i. the solenoid valve regulating the passage of water opens to enable introducing water into the leak-tight cavity and drum until the level sensor, integrated inside the drum or leak-tight cavity, detects that the level of water accumulated in the drum is optimum and sends a signal which closes the solenoid valve;

ii. once the solenoid valve has been closed, the pump regulating the passage of the dyeing agent is activated for a predetermined time in order to introduce a predetermined amount of dyeing agent into the drum and thereby obtain a dye solution in optimal proportions;

iii. the water and dyeing agent are mixed inside the drum, and the mixture is optionally heated at a predetermined temperature the dye solution resulting from mixing;

iv. once the dye solution has been obtained, it is discharged from the drum to the recovery tank to enable introducing the parts that must be treated in the drum;

v. the dye solution is recirculated from the recovery tank back to the drum by means of a recirculation pump to perform the surface coating of the parts introduced in the drum, and this operation is repeated in several work cycles; and vi. finally, once the service life cycle of the dye solution has been reached, it is discharged from the leak-tight cavity to the treatment tanks by means of a discharge system.

Optionally, once the dye solution has been discharged from the drum to the treatment tanks, a leak-tight cavity washing program can be performed before starting the next work cycle.

Before starting, during, or after completing a work cycle of the device, a user can select different programs stored in a memory of the control unit of the device so that the device performs actions automatically, and depending on the selected programs, perform them sequentially. Some of the programs stored in the memory are:

i. A mixing program in which a new dye solution is prepared by introducing water and a dyeing agent into the drum to be mixed.

The recommended service life of the dye solution is about 5 work cycles or an approximate duration of one week, provided that not more than 5 work cycles have been performed.

ii. A conditioning program for conditioning the dye solution for use, i.e., the solution being in working conditions that are optimum for use.

This program preheats the dye solution using the heating means included in the device if a predetermined period of time, usually between 1 and 2 days, has elapsed from the last work cycle.

iii. A coating program for coating parts under predetermined temperature conditions, preferably at a temperature of at least 50° C., said temperature preferably being 60° C., and then a rinse cycle.

iv. A discharging program for discharging the dye solution once its service life cycle has been reached and/or exceeded after performing a predetermined number of work cycles.

v. A cleaning program for cleaning the leak-tight cavity, the recovery tank, and the network of conduits once the dye solution has been discharged.

Moreover, there is also the possibility of the control unit automatically selecting one of the programs stored in its memory depending on the programs selected by the user or the number of work cycles performed previously in other operations.

Preferably, the water introduced in the leak-tight cavity including the drum is water that is already heated to thereby reduce the use of the heating means included in the cavity, reducing the power consumption of the device, in addition to accelerating the surface treatment process, limiting the use of the heating means only when the dye solution conditioning program is selected.

The dyeing agent can preferably be selected from a group comprising at least: one water-based liquid dye, powder or pigment dyes, coloring, or other dyeing agents available to a user, the dyeing agent preferably being said water-based liquid dye.

Preferably, the dyeing agent used in the dye solution gives the parts a final coating that has a dark shade, mainly a black shade, and optionally grayish shades.

In a preferred embodiment, the dye solution obtained from the mixture of water and dyeing agent has an approximate proportion of 10 to 1, respectively, for normal working conditions. However, this proportion can be modified depending on the dyeing agent used, the volume of parts to be coated, the geometry or design of said parts, the properties of the suffice coating, and/or the type of final surface coating to be obtained.

It will be understood that references to geometric position, such as for example, parallel, perpendicular, tangent, etc., allow deviations of up to ±5° with respect to the theoretical position defined by said nomenclature.

It will be understood that the end values of any offered range of values may not be optimal and adaptations of the invention may be required so that said end values are applicable, said adaptations being within reach of one skilled in the art.

Other features of the invention will become apparent in the following detailed description of an embodiment.

BRIEF DESCRIPTION OF THE DRAWINGS

The foregoing and other advantages and features will be better understood based on the following detailed description of an embodiment in reference to the attached drawing which must be interpreted in an illustrative and non-limiting manner, in which:

FIG. 1 illustrates a schematic design of an embodiment of the device and the elements making up the device.

DETAILED DESCRIPTION OF AN EMBODIMENT

The attached drawings show illustrative non-limiting embodiments of the present invention.

FIG. 1 illustrates a schematic design of an embodiment of a device 1 for performing the surface coating of parts and the elements making up the device. Said device 1 is formed by an electronic control unit 8, a housing 2 inside which there is arranged a leak-tight cavity 3, a water inlet conduit 6*a*, and a dyeing agent inlet conduit 6*b*, wherein the water is preferably hot water and the dyeing agent is a water-based liquid dye, said conduit 6*a* being regulated by a first control device 9*a*, preferably a solenoid valve, and said conduit 6*b* being regulated by a second control device 9*b*, preferably a regulating/drive pump, both control devices 9*a*, 9*b* being controlled by said control unit 8 depending on signals captured by level sensors 30, 70, and 12.

There is arranged inside the leak-tight cavity 3 a drum 4 in which the parts to be coated are arranged through a gate (not illustrated in FIG. 1) which provides access to the inside of the drum 4. To simplify the diagram of the device 1 illustrated in FIG. 1, neither the drive shaft of the drum 4, or the actuator thereof, nor the imaginary geometric axis of the drum 4 are shown.

The cavity 3 includes a first level sensor 30 which is directly or indirectly connected to the solenoid valve regulating the flow of water to the inside of the cavity 3 through the water inlet conduit 6*a*.

There is installed below the housing 2 of the device a recovery tank 7 connected with the cavity 3 of the device through a recirculation circuit 7*a* formed by multiple conduits, which allows recirculating the dye solution in the device by means of a drive pump 7*b* installed in the recirculation circuit 7*a*. Furthermore, the recovery tank 7 has a second level sensor 70, the function of which is safety related to preventing possible leaks or spillage, said sensor 70 being configured for detecting if the level of dye solution or fluid inside the tank 7 exceeds a predetermined maximum level, and if said maximum level is exceeded, closing or locking the control devices 9*a*, 9*b* to prevent the entry of more water or dyeing agent to the device 1, as it is directly or indirectly connected to the control devices 9*a*, 9*b* controlled by the control unit 8.

The device 1 furthermore includes a discharge system 10 to enable discharging the dye solution once a predetermined number of work cycles has been performed or a period of service life of said dye solution has been exceeded, said system having at least one outlet conduit 10*a* from the leak-tight cavity 3 including the drum 4, wherein each outlet 10*a* has a discharge pump 10*b* and a non-return valve 10*c* arranged at the outlet of said discharge pump 10*b*. As indicated above, there can be multiple outlet conduits 10*a* (not illustrated), wherein each outlet 10*a* directs the dye solution to a single water treatment tank 11 or to a water treatment tank 11 associated with each outlet conduit 10*a*, to enable suitably treating the dye solution.

In a preferred embodiment as illustrated in FIG. 1, the discharge system 10 includes a single outlet conduit 10*a* from the leak-tight cavity 3, which splits into at least two branched conduits, each of said branched conduits being equipped with a discharge pump 10*b* and an associated non-return valve 10*c*, regulating the flow of the dye solution to a single water treatment tank 11 or preferably different water treatment tanks 11 each independently connected to one of the at least two branched conduits, the water treatment tanks 11 being arranged remotely with respect to the device 1.

Regardless of the number of water treatment tanks 11, each tank 11 has a level sensor 12 for regulating the flow of dye solution from the device 1 to the tank 11 through the at least one outlet conduit 10*a* to prevent possible spillage, said level sensor 12 being independently connected, in a direct or indirect manner, to each discharge pump 10*b* of each outlet conduit 10*a*, determining if it must activate or deactivate said discharge pump 10*b* depending on the signal emitted by the level sensor 12 which indicates if a maximum safety level has been reached and/or exceeded, in which case the discharge pump 10*b* will be deactivated, preventing the passage of the dye solution through the outlet conduit 10*a* to the water treatment tank 11 until the level inside the tank 11 has gone down.

It must be pointed out that any other possible configuration of the discharge system 10 not contemplated above, whether in terms of the number of outlet conduits 10*a*, the amount of water treatment tanks 11, or the final distribution between the outlet conduits 10*a* and the water treatment tanks 11, must be considered equivalent to the described configurations, in addition to being obvious for one skilled in the art.

In this particular embodiment, the water inlet conduit 6*a*, the dyeing agent inlet conduit 6*b*, the recirculation circuit 7*a*, and the outlet conduit 10*a* are directly connected to the leak-tight cavity 3 inside the device 1 which contains the drum 3 therein.

It will be understood that the different parts making up the invention described in one embodiment can be freely combined with parts described in other different embodiments even though said combination has not been explicitly described, provided that the combination does not entail any drawback.

What is claimed is:

1. A device (1) for performing a surface coating of pieces, wherein said device (1) comprises a housing (2) including at least:

one leak-tight cavity (3) containing a drum (4) where the pieces to be coated are introduced, heating means (5), at least one water inlet conduit (6*a*) and one dyeing agent inlet conduit (6*b*) for entry to said leak-tight cavity (3) and drum (4), and a recovery tank (7) in communication with said leak-tight cavity (3) and a fluid recirculation circuit (7*a*) from said recovery tank (7) to said leak-tight cavity (3) and drum (4), wherein said at least one water inlet conduit (6*a*) and dyeing agent inlet conduit (6*b*) are operated by a control unit (8) by means of a control device (9*a*, 9*b*), wherein said leak-tight cavity (3) includes a first level sensor (30) which is directly or indirectly connected to said control device (9*a*) of the at least one water inlet conduit (6*a*), such that the entry of water to the leak-tight cavity (3) is interrupted when a specific level, compatible with its capacity, is reached inside the cavity (3), and wherein the recovery tank (7) includes at least a second level sensor (70) directly or indirectly connected to the control device (9*a*, 9*b*) of the at least one water inlet conduit (6*a*) and of the at least one dyeing agent inlet conduit (6*b*), such that the entry of water and dyeing agent to the leak-tight cavity (3) is interrupted if a specific level, compatible with its capacity, is exceeded inside the recovery tank (7).

2. The device (1) for the surface coating of pieces according to claim 1, furthermore including a discharge system (10) of the leak-tight cavity (3) comprising at least one outlet (10*a*) of said cavity (3), each outlet (10*a*) being controlled by a discharge pump (10*b*), wherein each outlet (10*a*) of the discharge system (10) is connected to one or more water treatment tanks (10.

3. The device (1) for the surface coating of pieces according to claim 2, wherein each discharge pump (10*b*) is automatically activated by said control unit (8) once the mixture of water and dyeing agent has performed a number of predetermined recirculation cycles.

4. The device (1) for the surface coating of pieces according to claim 2, wherein each discharge pump (10*b*) is controlled by a level sensor (12) integrated in the one or more water treatment tanks (11).

5. The device (1) for the surface coating of pieces according to claim 1, wherein the level sensor (30) of the leak-tight cavity (3) is an analog transducer.

6. The device (1) for the surface coating of pieces according to claim 1, wherein the drum (4) has a cylindrical geometry.

7. The device (1) for the surface coating of pieces according to claim 1, wherein the drum (4) performs an oscillating movement or a rotational movement about a drive shaft operated by an actuator.

8. The device (1) for the surface coating of pieces according to claim 7, wherein said drive shaft is horizontal and coaxial to a central axis defined by the geometry of the drum (4).

9. The device (1) for the surface coating of pieces according to claim 1, wherein said heating means (5) are formed by heating coils with two thermal contacts, controlled by a programmable safety relay.

10. The device (1) for the surface coating of pieces according to claim 1, wherein the heating means (5) are: included inside the drum (4).

11. The device (1) for the surface coating of pieces according to claim 1, wherein the control device (9*a*) of the at least one water inlet conduit (6*a*) is a solenoid gate valve and wherein the control device (9*b*) of the at least one dyeing agent inlet conduit (6*b*) is a pump.

12. The device (1) for the surface coating of pieces according to claim 3, wherein each discharge pump (10*b*) is controlled by level sensor (12) integrated in the one or more water treatment tanks (11).

13. The device (1) for the surface coating of pieces according to claim 6, wherein the drum (4) performs an oscillating movement or a rotational movement about a drive shaft operated by an actuator.

14. The device (1) for the surface coating of pieces according to claim 9, wherein the heating means (5) are included inside the drum (4).

* * * * *